United States Patent [19]

Jahnke

[11] 4,192,769

[45] Mar. 11, 1980

[54] RUST INHIBITOR ADDITIVE COMPOSITIONS, METHOD OF MAKING, AND AQUEOUS FLUIDS CONTAINING THE SAME

[75] Inventor: Richard W. Jahnke, Mentor-On-The-Lake, Ohio

[73] Assignee: The Lubrizol Corporation, Wickliffe, Ohio

[21] Appl. No.: 905,502

[22] Filed: May 12, 1978

[51] Int. Cl.[2] ..... C23F 11/14; C23F 11/12

[52] U.S. Cl. ..... 252/389 R; 106/14.13; 106/14.18; 148/6.14 R; 252/390; 252/392; 422/12; 422/16

[58] Field of Search ..... 252/389 R, 390, 392; 422/12, 16; 148/6.14 R

[56] References Cited

U.S. PATENT DOCUMENTS

| | | | |
|---|---|---|---|
| 2,638,449 | 5/1953 | White et al. | 252/51.5 |
| 2,726,215 | 12/1955 | Jones | 252/389 R |
| 3,531,411 | 9/1970 | Benson et al. | 252/32.5 |
| 3,556,994 | 1/1971 | Diery et al. | 252/389 R |
| 3,788,988 | 1/1974 | Dubourg | 252/32.5 |
| 3,893,931 | 7/1975 | Sturwold et al. | 252/396 |
| 3,897,349 | 7/1975 | Marin et al. | 252/389 R |
| 3,931,020 | 1/1976 | Burgess et al. | 252/30 |
| 3,940,339 | 2/1976 | Clarke et al. | 252/392 |
| 4,043,925 | 8/1977 | Felton | 252/49.3 |
| 4,053,426 | 10/1977 | Davis et al. | 252/392 |
| 4,072,626 | 2/1978 | Finney | 252/389 A |
| 4,113,498 | 9/1978 | Rones et al. | 252/390 |

*Primary Examiner*—Richard E. Schafer
*Assistant Examiner*—Irwin Gluck
*Attorney, Agent, or Firm*—James W. Adams, Jr.; Daniel N. Hall

[57] ABSTRACT

The anti-rust properties exhibited by the aqueous fluids described herein are provided by one or more of the rust inhibitor additive composition prepared by reacting:

(A) at least one aliphatic polycarboxylic acid acylating agent characterized by the presence within its structure of an aliphatic hydrocarbyl-substituent with (B) at least one hydroxy-substituted aliphatic amine, and (C) at least one basically reacting alkali metal compound.

49 Claims, No Drawings

RUST INHIBITOR ADDITIVE COMPOSITIONS, METHOD OF MAKING, AND AQUEOUS FLUIDS CONTAINING THE SAME

BACKGROUND OF THE INVENTION

1. Field of the Invention

The present invention relates to additive compositions for use as rust inhibitors in liquid media coming into contact with ferrous metals. More particularly, the invention is concerned with rust inhibitor additives which are capable of being stably dispersed, or soluble, in aqueous media.

2. Description of the Prior Art

It is well known that ferrous metal surfaces tend to rust soon after coming into contact with water. The tendency of the metal surface to rust is especially noticeable in metal cutting or metal working operations. In such operations the freshly cut or worked surface is very susceptible to rusting (oxidation) by water, moisture or aqueous media. For economic reasons, aqueous solutions or fluids including aqueous emulsions have been used extensively as both lubricants and coolants in many ferrous metal cutting operations. One major concern with such aqueous fluids is how to best minimize or eliminate their otherwise severe rusting and corroding effects on ferrous metal surfaces. Thus, an effective rust inhibitor has always been a must additive to any of the foregoing aqueous media.

A host of rust-inhibitor additives in aqueous media have been proposed in the prior art. Such additives have comprised phosphate esters, phosphate esters adducts with ethylene oxide and phenol, salts of aromatic acids such as benzoic, toluic, naphthoic, phthalic acid with aliphatic amines, nitrous acid salts of long chain aliphatic amines such as the nitrous acid salt of octadecylamine, or salts of aromatic sulfonamidocarboxylic acids. Other known rust-inhibitors also include those additives formed from combining metal salts with alcohols or amines; graphite, borax, clay, and silica-containing compounds; and condensation products of alkali metal or alkaline earth metal borate with polyhydric alcohols.

One particularly effective rust-inhibitor additive has been sodium nitrite. The fact that sodium nitrite is water-soluble, commercially available, and easy to use has assisted in its wide acceptance as a rust inhibitor in aqueous cutting fluids. Recent findings, however, have made use of sodium nitrite in cutting fluids undesirable and possibly hazardous. Apparently, at elevated temperatures sodium nitrite reacts with organic amines, often found in cutting fluids, to form nitrosoamines which are suspected as potential carcinogenic materials.

Efforts have been extensive to prepare rust inhibitor additives which are safe yet as equally effective in aqueous systems as sodium nitrite.

It is therefore the primary object of the present invention to provide novel compositions for inhibiting the rusting of ferrous metal surfaces in contact with water or aqueous solutions.

Another object of the invention is to provide novel aqueous industrial fluids which have rust-inhibiting properties and novel concentrates for preparing the same. A further object of the invention is to provide a novel method for metal working, and especially metal cutting, wherein a novel aqueous industrial fluid having anti-rust properties is utilized. Other objects and advantages will become apparent from the following descriptions.

SUMMARY OF THE INVENTION

In one aspect the present invention comprises an effective rust-inhibitor additive composition which is prepared by reacting at least one hydrocarbyl-substituted aliphatic polycarboxylic acid acylating agent with at least one hydroxy-substituted aliphatic amine, and at least one basically reacting alkali metal compound. The rust inhibitor additive described herein is particularly suited for aqueous metal cutting fluids.

DETAILED DESCRIPTION OF THE INVENTION

The anti-rust additive composition of the present invention is a complex product obtained by the interreaction of at least three separate components. Component (A) represents the polycarboxylic acid acylating agent; Component (B) represents the hydroxy-substituted aliphatic amine; and Component (C) is the basically reacting alkali metal compound. The three components can be reacted simultaneously to prepare the final additive composition. However, it is generally preferred that the acylating agent (A) is reacted first with amine (B) under conventional acylating reaction conditions, followed by the reaction with the alkali metal compound (C). Alternatively, the acylating agent (A) can be reacted first with the basically reacting alkali metal compound (C), followed by reacting with amine (B).

For clarity, the term "poly" in polycarboxylic acid denotes a number greater than one. Accordingly, aliphatic polycarboxylic acids encompass essentially all aliphatic carboxylic acids except monocarboxylic acids. For efficiency and economy, however, dicarboxylic acids acylating agents are preferred. Typical dicarboxylic acid acylating agents are aliphatic hydrocarbyl-substituted succinic, glutaric, pimelic, suberic, azelaic or sebacic acids, the anhydrides, and the lower alkyl esters thereof. (The term "lower alkyl" as used in "lower alkyl esters" is intended to identify alkyl groups of up to seven carbon atoms.)

It is preferred that the polycarboxylic acid acylating agents be dicarboxylic acid acylating agents of up to about 12 carbon atoms such as those named above, said agents being substituted with aliphatic hydrocarbyl substituents having from 4 to about 30 carbon atoms, preferably from 4 to about 22 carbon atoms. The source of the aliphatic hydrocarbyl substituent is not a critical aspect of the invention. Usually the substituents will be derived from various olefinic monomers such as ethylene, propylene, butylene, hexene, octene, decene, etc., including the oligomers, prepolymers or low molecular weight polymers formed from the foregoing monomers. Thus, dimers, trimers or tetramers of propylene and butylene can be used so long as the average number of carbon atoms contained therein does not exceed about 30. The reason for the carbon atom limitation in the substituent relates to water solubility and/or dispersibility. Usually, the aliphatic hydrocarbyl substituent will contain from about 4 to about 22 carbon atoms, preferably from 4 to about 16 carbon atoms.

The hydrocarbyl-substituted polycarboxylic acid acylating agents (Component (A)) are well-known and can be prepared by known procedures. One particularly useful procedure is to react a monoolefin monomer or oligomer as described above with an unsaturated dicarboxylic acid anhydride, such as maleic anhydride, at 100°-200° C. with or without a catalyst to form the corresponding alkenyl succinic anhydride. The monoolefin monomer or oligomer can be unsaturated in the α-position such as in 1-butene, 1-hexene, 1-octene, and 1-decene, or in a medial position such as in 2-butene, 3-pentene, or 4-octene. The same is true of the oligomers. The monomer also can be replaced by an alkyl halide which is capable of being substituted on the unsaturated acid.

The aliphatic hydrocarbyl substituent can be saturated or unsatured, straight or branched. The hydrocarbyl substituent may contain polar groups provided, however, that such groups are not present in significantly large proportions to alter the hydrocarbon character of the substituent. Polar groups are typified by halo, carbonyl, nitro and similar groups.

The amines (Component (B)) contemplated by the present invention comprise compounds having the structural formula

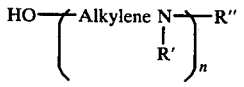

wherein Alkylene is a straight or branched chain of 2 to 4 carbon atoms; R′ is H, alkyl of up to 4 carbon atoms or HO-Alkylene; R″ is H, or alkyl of up to 4 carbon atoms and n is a number from 1 to 8. When n is greater than 1 and/or when R′ is HO-Alkylene, the Alkylene groups need not be the same. Alkanolamines, dialkanolamines and mixtures of two or more of any of these represent preferred amines. Typical dialkanolamines include diethanolamine, dipropanolamine, di-tert-butanolamine, di-isopropanolamine, 2,2′-iminodibutanol, 3,3′-iminodipentanol-2, N-(hydroxyethyl)-propanolamine. For improved efficiency and, due to their commercial availability, ethanolamine, diethanolamine and hydrocarbon-substituted diethanolamines are preferred. The latter diethanolamines can be represented by H—H—$(CH_2CHR_1OH)_2$ wherein $R_1$ is H or a hydrocarbyl radical, preferably a lower alkyl radical of up to 7 carbon atoms, preferably of 1 to 4 carbon atoms.

The reaction of the hydrocarbyl-substituted polycarboxylic acid acylating agent (Component (A)) with the amine (Component (B)) is effected at a temperature in the range of from about 80° to about 200° C., preferably in the range of from about 100° to about 180° C. and most preferably from about 130° to about 160° C. Removal of water formed as a by-product should be facilitated in order for the reaction of (A) and (B) to proceed. The reaction can be carried out with or without a solvent. If desired, an inert liquid organic diluent can be used in the reaction to assist in the mixing, temperature control, or even in the removal of water. Inert organic diluents or solvents include the aliphatic, cycloaliphatic, and aromatic hydrocarbons and their chlorinated analogs. Examples of such diluents are pentane, hexane, heptane, cyclohexane, benzene, toluene, xylene, chlorobenzene, diphenyl ether, chlorohexane, and the like.

The proportions of the acylating agent and amine reactants may vary considerably. However, on an equivalent basis, the equivalent ratios of the amine (Component (B)) to the acylating agent (Component (A)) should be (B):(A) from about 2:1 to about 1:10. Improved results are obtained with ratios of (B):(A) being from about 2:1 to about 1:5.

For clarity, by equivalent weight of Component (A) is meant a weight derived from dividing the molecular weight of the acylating agent by the number of carboxylic groups. Thus, aliphatic hydrocarbyl-substituted succinic acids, anhydrides or their alkyl esters have two equivalents per molecular weight thereof. As to the amine (Component (B)) equivalent weight denotes the molecular weight divided by the number of functional groups within the molecule of amine component. Only the groups —$NH_2$, >NH, and —OH are considered as functional groups. Thus, diethanolamine,

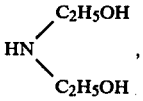

has three equivalents per molecular weight and ethanolamine, 2 equivalents.

The third reactant (Component (C)) comprises at least one basically reacting alkali metal compound. The preferred alkali metals are lithium, sodium and potassium. Basic alkali metal compounds include hydroxides, alkoxides, oxides, hydrates and mixtures of two or more of such basic compounds. The alkoxides are preferably those derived from monohydric alkanols of up to about 7 carbon atoms. For efficiency and economy the hydrates and hydroxides constitute the preferred basic compounds. Thus, lithium hydroxide, sodium hydroxide, potassium hydroxide and/or their hydrates are preferred.

The reaction between the hydrocarbyl-substituted carboxylic acid acylating agent (Component (A)) and the amine (Component (B)) is preferably followed by reaction with the basically reacting alkali metal compound (Component (C)). The latter reaction can be carried out by adding Component (C) to the previously formed nitrogen-containing intermediate (Components (A) and (B)), and heating the mixture to about 60° to about 100° C. for up to about three hours. Higher or lower temperatures, longer or shorter reaction times can be used, however, depending on the specific nature of the reactants employed. Preferably, the reaction of Component (C) with the nitrogen-containing intermediate is conducted in aqueous media at temperatures of about 60° to about 90° C. Inert solvents or diluents suitable for this type of reaction can be used, if desired so long as the basic compound (Component (C)) can react. The proportions of Component (C) can vary, but for good results there should be at least 0.1 of equivalent of the Component (C) for each equivalent of Component (A). Better results are obtained if the equivalent ratio between Component (C) and Component (A) is about 1:5 to about 1:1. An equivalent of the basic compound Component (C) is equal to its molecular weight divided by the number of alkali metal atoms in the compound; thus, LiOH, NaOH, KOH, $Li(OH).H_2O$, and sodium methoxide each have one equivalent per molecular weight.

As indicated earlier, the preparation of the rust inhibitor of the present invention can be effected by several routes such as by the initial reaction of Component (A) with Component (B) to form a nitrogen-containing intermediate followed by the reaction of said intermediate with Component (C); the simultaneous reaction of all three components; or the reaction of (A) with (C) to form an alkali metal-containing intermediate followed by the reaction of said intermediate with (B). The rust inhibitor composition is prepared at least by reacting one equivalent of the acylating agent (A) with at least 0.1 equivalent of the amine (B) and 0.1 equivalent of the compound (C). Higher equivalent contents of (B) and (C) per one equivalent of (A) are often desirable which are attainable easily by certain preparative routes. For example, the acylation reaction between (A) and (B) can be carried out to ratios of A:B of 1:1 with relative ease under proper conventional acylating reaction conditions. Thus the nitrogen-containing intermediate is best prepared in this manner, and subsequently reacted with the basically reacting compound (Component (C)), as described hereinbefore.

The simultaneous reaction of the three components can be carried out in an aqueous medium at temperatures of about 40° to about 100° C., or in an inert solvent to higher temperatures; i.e., up to about 200° C., preferably about 130° to about 160° C. Removal of the unreacted portions of the reactants, if desired, is done conventionally by physical separation or other procedures known to the art.

The reaction between the acylating agent (Component (A)) and the alkali metal compound (Component (C)) is normally conducted in aqueous media at temperatures of about 40° to about 100° C. The resulting alkali metal-containing intermediate is reacted with the amine at about 80° to about 200° C., preferably at about 130° to about 160° C.; preferably in a suitable solvent such as toluene to minimize the effect of the water present on the acylation reaction.

The rust inhibitor composition of the present invention is not limited to those made from only one of each of Components (A), (B) and (C). Often a mixture of each of (A), (B) and/or (C) is used to prepare the rust inhibitor compositions. For example, a mixture of several hydroxyamines and/or two or more acylating agents and/or two or more alkali metal compounds can be used. Techniques known to the art for determining functionalities and equivalents of mixtures can be followed to determine the various proportions needed. Likewise, mixtures of two or more separately prepared rust inhibitors of this invention may be used as a single rust inhibitor.

The rust inhibitor additive composition of the present invention (that is, the products made from Components (A), (B) and (C) as discussed above) should be at least stably water dispersible, and preferably soluble, in aqueous media. For clarity, the term "soluble in aqueous media" as used herein does not mean necessarily that the additives of the invention are miscible or soluble in all proportions in aqueous media. Rather, it is intended to mean that the rust inhibitor additive is soluble in a given aqueous medium in useful proportions. In this context, it is not necessary that such aqueous solutions be true solutions in the strict physical chemical sense. Such solutions may instead be colloidal dispersions or suspensions which, for the purpose of the invention, would exhibit properties sufficiently associated with those of true solutions. Similarly, the term "stably water-dispersible" in aqueous media denotes a rust inhibitor composition which is capable of being stably dispersed in an aqueous medium to the extent that allows it to function as a rust inhibitor. The dispersion can be effected by various conventional ways including physical mixing and agitation. For purpose of this application and the appended claims, the term "stably water-dispersible" is intended to include "soluble in aqueous media" unless otherwise stated.

The rust inhibitor additive compositions of the present invention are used in aqueous fluids coming in contact with ferrous metal surfaces for the purpose of inhibiting the rusting and/or corrosion of such surfaces. Aqueous metal-cutting or metal-working fluids represent the major types of such fluids. Such fluids may also contain other conventional additives such as extreme pressure agents, bacteriacides, anti-foam agents, and others. It is, therefore, desirable that the rust inhibitor additive compositions of this invention be compatible with such other conventional additives. The rust inhibitor additive compositions of the present invention have been found compatible with conventional additives found in aqueous metal-cutting and metal-working fluids at various proportions and concentrations.

By and large, rust inhibitors of the present invention are incorporated into such aqueous fluids in amounts such that they approximate about 0.1% to about 2% by weight based on the total weight of the aqueous fluid, with levels of about 1% being typical. The rust inhibitor additive compositions of the present invention have shown effectiveness in metal-cutting fluids at levels as low as about 0.05% by weight.

Because the rust inhibitor additive compositions of the invention are contemplated for use in aqueous media, it is advantageous to prepare them as aqueous concentrates in which about 2% to about 60% by weight of the total weight of the concentrate is one or more rust inhibitor additive compositions of the invention. Other conventional additives as mentioned hereinbefore may also be present in the concentrates.

The following examples illustrate more clearly the additive compositions of the present invention. These examples, however, should not be interpreted or construed as specific limitations on the invention. In these examples all temperatures are in degrees Centigrade and all parts are parts by weight.

EXAMPLE I

160 Parts of tetrapropenyl substituted succinic anhydride (prepared by reacting maleic anhydride with a polypropylene tetramer) is charged to a reactor equipped with a condenser, stirrer, thermometer, and nitrogen inlet and outlet. The anhydride is heated to 85° C. Diethanolamine (24 parts) is added gradually to the molten anhydride and the mixture is allowed to exotherm to 140° C. The relatively viscous liquid is held at 130°-140° C. for two hours under a nitrogen purge. The acid neutralization number to phenolphthalein (i.e., NNA(ph)), as determined by ASTM Procedure D-974, is 72.

The liquid is cooled to 100° C. and a solution of 18 parts $LiOH.H_2O$ and 173 parts $H_2O$ is added bringing the temperature down to 70° C. The contents are held for about two hours at 70°-80° C. after which 38 parts of diethylethanolamine is added and the entire solution is stirred and later cooled to ambient temperature yielding the desired rust inhibition product in aqueous but concentrated form (55% by weight).

EXAMPLE II

85 Parts of n-octylsuccinic anhydride (obtained from Humphrey Chemicals) is charged to a reactor equipped as described in Example I, and heated until molten. The temperature of the molten anhydride is raised to 85° C.

at which 47 parts of diethanolamine is added gradually over one-half hour. The liquid mixture in the reactor is allowed to exotherm to about 130° C. The contents are held at 130°-150° C. for three hours as water is collected. The NNA(ph) is 110. 27 Parts of diethylethanolamine are added and the contents in the reactor are cooled to 115° C. Further cooling to 65° C. is accomplished by the addition of 137 parts of $H_2O$. The aqueous solution is clear. 18.5 Parts of $LiOH.H_2O$ is added to the aqueous solution whose temperature is raised to 85° C. and maintained at 65°-85° C. for one hour. 2 Parts of filter aid (diatemaceous earth) is added and the contents are filtered to yield a clear aqueous, concentrated solution of the rust inhibitor of the present invention (55% by weight).

EXAMPLE III

133 Parts of the tetrapropenyl substituted succinic anhydride of Example I is charged to a suitable reactor and heated to 80° C. 45.8 Parts of ethanolamine is added gradually to the anhydride and the mixture is allowed to exotherm to 140° C. with nitrogen purging. The temperature is maintained at 140°-150° C. for four hours during which 10 parts of water are collected. The NNA(ph) is determined to be 5. 195 Parts of $H_2O$ is added to the reaction mixture in the reactor to bring the temperature down to 80° C. 38.23 Parts of diethylethanolamine is added, followed by 21.9 parts of $LiOH.H_2O$. The entire contents in the reactor are now maintained at 80° C. for one hour. Filter aid is added (2.5 parts) and the contents are filtered to yield the aqueous concentrated solution of the rust inhibitor additive of the invention.

EXAMPLE IV

400 Parts of tetrapropenyl-substituted succinic anhydride are charged to a reactor similar to the one described in Example I and heated to 85° C. whereupon 92 parts of ethanolamine is added gradually over a 0.3 hour period. The mixture is allowed to exotherm to 120° C. and later the reaction is cooled by means of an ice bath and regulating the addition of ethanolamine. The contents are then held at 105°-110° C. for a five-hour period. The NNA(ph) of the intermediate is 65.

141 Parts of water and 10 parts of 85% potassium hydroxide is charged to a suitable second reactor and stirred until dissolved. To the second reactor 131 parts of the intermediate described above is added over a 0.1 hour period and stirred until dissolved. 28 Parts of diethylethanolamine is added and the contents of the reactor are stirred for 0.1 hour. 16 Parts of 85% potassium hydroxide is added and stirred until dissolved, yielding the desired rust inhibitor product in aqueous form.

EXAMPLE V

82 Parts of isooctyldecenyl-substituted succinic anhydride are charged to the same type reactor described in Example I. The anhydride is heated to 85° and 29 parts of diethanolamine is added gradually to it. The reaction mixture is allowed to exotherm to 125° C. and is held at 125°-150° C. for two hours during which water is collected. The NNA(ph) is 67. The reaction mixture is cooled slightly and 23 parts of diethylethanolamine is added cooling the mixture to 115° C. Water (120 parts) is then added, cooling the mixture to 68° C. After mixing the contents 11.8 parts of $LiOH.H_2O$ are added and the solution is held at 68°-85° C. for one hour. Filter aid is added (2.0 parts) and the contents are filtered to yield an aqueous concentrated solution of the rust inhibitor additive of the invention.

EXAMPLE VI

The procedure of Example III is followed except tetrapropanyl substituted glutaric acid (prepared by reacting tetrapropanyl chloride with glutaric acid) is substituted for the tetrapropenyl substituted succinic anhydride.

EXAMPLE VII

The procedure of Example III is followed except tetrapropanyl substituted pimelic acid (prepared by reacting tetrapropanyl chloride with pimelic acid) is substituted for the tetrapropenyl substituted succinic anhydride.

EXAMPLE VIII

The procedure of Example III is followed except tetrapropanyl substituted suberic acid (prepared by reacting tetrapropane chloride with suberic acid) is substituted for the tetrapropenyl substituted succinic anhydride.

EXAMPLE IX

The procedure of Example III is followed except tetrapropenyl substituted 2-pentene-1,3,5-tricarboxylic acid (prepared by reacting tetrapropylene tetramer with the unsaturated polycarboxylic acid obtained by dehydration of citric acid) is substituted for the tetrapropenyl substituted succinic anhydride.

EXAMPLE X 14.5 Parts water, 1.68 parts $LiOH.H_2O$ and 3.0 parts ethanolamine are charged to a suitable reactor and heated to 40° C. 10.0 Parts of the tetrapropenyl substituted succinic anhydride of Example 1 is added. The mixture exotherms to 60° C. After 0.083 hour, 2.8 parts diethylethanolamine is added yielding the desired rust inhibitor product in aqueous form.

EXAMPLE XI

A cutting fluid concentrate for use on steel is prepared as follows:

2% Grotan (a commercially available biocide)
5% triethanolamine
15% Keil Base 865 (a commercially available sulfur and chlorine-containing E.P. agent)
58% water
20% aqueous rust inhibitor of Example I.

The above concentrate is diluted with water to a 20:1 ratio (by volume) and the resulting fluid is shown to have excellent anti-rust and anti-corrosion properties.

EXAMPLE XII

A cutting fluid concentrate similar to the one described in Example XI is prepared with the aqueous rust inhibitors of Examples II through VI all showing excellent rust inhibiting and anti-corrosion properties.

EXAMPLE XIII

LIGHT DUTY METAL GRINDING FLUID is prepared comprising:

3% Grotan as in Example XI
5% triethanolamine
1% Nacap (a commercially available metal passivator obtained from Vanderbilt)

66% water

25% of the aqueous rust inhibitor prepared in Example II.

The above concentrate is diluted with water to a 50:1 ratio (by volume) to provide an excellent anti-rust, anti-corrosion light metal grinding fluid.

EXAMPLE XIV

Light duty grinding fluids similar to Example XIII are prepared by substituting the rust inhibitor of Example II with the rust inhibitors prepared in Examples III through X showing the same excellent results.

What is claimed is:

1. A stably water-dispersible rust inhibiting composition prepared by the process which comprises reacting (A) at least one aliphatic polycarboxylic acid acylating agent characterized by the presence within its structure of an aliphatic hydrocarbyl-substituent with (B) at least one hydroxy-substituted aliphatic amine, and (C) at least one basically reacting alkali metal compound.

2. A composition according to claim 1 prepared by reacting at least one equivalent of (A) with at least 0.1 equivalent of (B), and at least 0.1 equivalent of (C).

3. A composition according to claim 2 wherein the ratio, in equivalents, of (B) to (A) is from about 1:5 to about 2:1, and the ratio, in equivalents, of (C) to (A) is from about 1:5 to about 1:1.

4. A composition according to claim 1 wherein (A) and (B) are first reacted to form a nitrogen-containing intermediate and said intermediate is subsequently reacted with (C).

5. A composition according to claim 1 wherein (A) and (C) are first reacted to form an alkali metal-containing intermediate which is subsequently reacted with (B).

6. A composition according to claim 1 wherein (A), (B), and (C) are reacted simultaneously.

7. A composition according to claim 1 wherein (A) is selected from the group consisting of dicarboxylic acids, their anhydrides, their lower alkyl esters, and mixtures of two or more of any of these wherein the aliphatic hydrocarbyl substituent is straight or branched chain and saturated or unsaturated.

8. A composition according to claim 7 wherein (B) is one or more amines selected from the group consisting of those represented by the formula

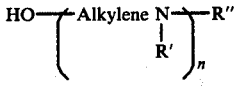

wherein Alkylene is straight or branched chain and contains from 2 to about 4 carbon atoms; R' is H, alkyl of up to about 4 carbon atoms, or HO—Alkylene—, R'' is H or lower alkyl of up to about 4 carbon atoms, and n is a number of 1–8.

9. A composition according to claim 8 wherein the alkali metal compound in (C) is a member selected from the group consisting of alkali metal hydroxides, hydrates, lower alkoxides, and mixtures of two or more of any of them.

10. The composition of claim 9 wherein the metal in said alkali metal compound is selected from lithium, sodium and potassium.

11. The composition of claim 10 wherein the alkali metal compound is lithium.

12. The composition of claim 9 wherein the amine is a dialkylethanolamine.

13. The composition of claim 12 wherein the amine is a diethylethanolamine.

14. The composition of claim 9 wherein the amine is a dialkanolamine.

15. The composition of claim 14 wherein the amine is diethanolamine.

16. The composition of claim 14 wherein the amine is di-isopropanolamine.

17. The composition of claim 14 wherein the amine is di-tert-butanolamine.

18. The composition of claim 9 wherein the aliphatic hydrocarbyl substituent on the acylating agent contains up to about 30 carbon atoms.

19. The composition of claim 18 wherein the hydrocarbyl substituent contains from 4 to about 22 carbon atoms.

20. A stably water-dispersible rust inhibiting composition prepared by the process which comprises reacting (A) at least one aliphatic dicarboxylic acid acylating agent characterized by the presence within its structure of an aliphatic hydrocarbyl substituent with (B) at least one hydroxy-substituted aliphatic amine, and (C) at least one basically reacting alkali metal compound selected from oxides, hydroxides, hydrates, or alkoxides of lithium, sodium, or potassium.

21. The composition of claim 20 wherein the aliphatic hydrocarbyl substituent contains from 4 to about 30 carbon atoms.

22. The composition of claim 21 wherein the amine is selected from dialkylalkanolamines, dialkanolamines, and mixtures of two or more of any of these.

23. The composition of claim 22 wherein the dicarboxylic acid acylating agent is selected from succinic acid, succinic anhydride, and lower alkyl esters of succinic acid.

24. The composition of claim 23 wherein the acylating agent is tetrapropenyl-substituted succinic acid.

25. The composition of claim 24 wherein the hydroxyamine is a mixture of diethanolamine and diethylethanolamine.

26. The composition of claim 25 wherein the basically reacting compound is lithium hydrate.

27. The composition of claim 25 wherein the basically reacting compound is sodium hydroxide.

28. The composition of claim 25 wherein the basically reacting compound is potassium hydroxide.

29. An aqueous industrial fluid comprising a major amount of water and a minor effective amount sufficient to impart rust inhibiting properties thereto of a composition according to claim 1.

30. An aqueous industrial fluid comprising a major amount of water and a minor effective amount sufficient to impart rust inhibiting properties thereto of a composition according to claim 9.

31. An aqueous industrial fluid comprising a major amount of water and a minor effective amount sufficient to impart rust inhibiting properties thereto of a composition according to claim 14.

32. An aqueous industrial fluid comprising a major amount of water and a minor effective amount sufficient to impart rust inhibiting properties thereto of a composition according to claim 20.

33. An aqueous industrial fluid comprising a major amount of water and a minor effective amount sufficient to impart rust inhibiting properties thereto of a composition according to claim 26.

34. An aqueous industrial fluid comprising a major amount of water and a minor effective amount sufficient to impart rust inhibiting properties thereto of a composition according to claim 27.

35. An aqueous industrial fluid comprising a major amount of water and a minor effective amount sufficient to impart rust inhibiting properties thereto of a composition according to claim 28.

36. A method for inhibiting the rust of ferrous metal surfaces which are in contact with an aqueous medium, which comprises adding to said aqueous medium a minor effective amount of the rust inhibiting composition of claim 1.

37. A method for inhibiting the rust of ferrous metal surfaces which are in contact with an aqueous medium, which comprises adding to said aqueous medium a minor effective amount of the rust inhibiting composition of claim 9.

38. A method for inhibiting the rust of ferrous metal surfaces which are in contact with an aqueous medium, which comprises adding to said aqueous medium a minor effective amount of the rust inhibiting composition of claim 14.

39. A method for inhibiting the rust of ferrous metal surfaces which are in contact with an aqueous medium, which comprises adding to said aqueous medium a minor effective amount of the rust inhibiting composition of claim 20.

40. A method for inhibiting the rust of ferrous metal surfaces which are in contact with an aqueous medium, which comprises adding to said aqueous medium a minor effective amount of the rust inhibiting composition of claim 26.

41. A method for inhibiting the rust of ferrous metal surfaces which are in contact with an aqueous medium, which comprises adding to said aqueous medium a minor effective amount of the rust inhibiting composition of claim 27.

42. A method for inhibiting the rust of ferrous metal surfaces which are in contact with an aqueous medium, which comprises adding to said aqueous medium a minor effective amount of the rust inhibiting composition of claim 28.

43. An aqueous concentrate comprising from 2 to about 60% by weight of the composition of claim 1.

44. An aqueous concentrate comprising from 2 to about 60% by weight of the composition of claim 9.

45. An aqueous concentrate comprising from 2 to about 60% by weight of the composition of claim 14.

46. An aqueous concentrate comprising from 2 to about 60% by weight of the composition of claim 20.

47. An aqueous concentrate comprising from 2 to about 60% by weight of the composition of claim 26.

48. An aqueous concentrate comprising from 2 to about 60% by weight of the composition of claim 27.

49. An aqueous concentrate comprising from 2 to about 60% by weight of the composition of claim 28.

* * * * *